US008425764B2

(12) United States Patent
Lin et al.

(10) Patent No.: US 8,425,764 B2
(45) **Date of Patent: *Apr. 23, 2013**

(54) PROCESS FOR PRODUCING PETROLEUM OILS WITH ULTRA-LOW NITROGEN CONTENT

(75) Inventors: Tzong-Bin Lin, Chiayi (TW); Hung-Chung Shen, Chiayi (TW); Kuang-Yeu Wu, Plano, TX (US)

(73) Assignees: AMT International Inc., Plano, TX (US); CPC Corporation, Taiwan, Taipei (TW)

( * ) Notice: Subject to any disclaimer, the term of this patent is extended or adjusted under 35 U.S.C. 154(b) by 242 days.

This patent is subject to a terminal disclaimer.

(21) Appl. No.: 12/766,883

(22) Filed: Apr. 24, 2010

(65) Prior Publication Data

US 2010/0200461 A1 Aug. 12, 2010

Related U.S. Application Data

(62) Division of application No. 11/173,317, filed on Jun. 30, 2005, now Pat. No. 7,727,383.

(51) Int. Cl.
*C10G 17/00* (2006.01)

(52) U.S. Cl.
USPC ..... 208/254 R; 585/833

(58) Field of Classification Search ..... None
See application file for complete search history.

(56) References Cited

U.S. PATENT DOCUMENTS

| | | | | |
|---|---|---|---|---|
| 3,719,587 | A * | 3/1973 | Karchmer et al. | 208/208 R |
| 4,426,280 | A * | 1/1984 | Chen et al. | 208/254 R |
| 5,177,282 | A * | 1/1993 | Nierlich et al. | 585/329 |
| 5,296,133 | A * | 3/1994 | Kramer et al. | 208/400 |
| 5,298,157 | A * | 3/1994 | Kramer et al. | 208/400 |
| 6,297,417 | B1 * | 10/2001 | Samson et al. | 585/448 |
| 6,504,071 | B2 * | 1/2003 | Zhang et al. | 585/467 |
| 6,596,914 | B2 * | 7/2003 | Gore et al. | 585/833 |

* cited by examiner

*Primary Examiner* — Tam M Nguyen
(74) *Attorney, Agent, or Firm* — Cascio & Zervas

(57) ABSTRACT

A highly effective liquid-liquid extraction process to remove nitrogen compounds and especially basic nitrogen compounds from aromatic light petroleum oils with excellent recovery employs de-ionized water, which can be acidified, as the extractive solvent. The product is an aromatic hydrocarbon with ultra-low amounts of nitrogen poisons that can deactivate acidic catalysts. The extracted oils are suitable feedstock for the subsequent catalytic processes that are promoted with the high performance solid catalysts, which are extremely sensitive to nitrogen poison.

20 Claims, 5 Drawing Sheets

PROCESS FOR PRODUCING PETROLEUM OILS WITH ULTRA-LOW NITROGEN CONTENT

REFERENCE TO RELATED APPLICATIONS

This application is a divisional application of U.S. patent application Ser. No. 11/173,317 that was filed on Jun. 30, 2005, now U.S. Pat. No. 7,727,383.

FIELD OF THE INVENTION

The present invention relates to methods of removing substantially all nitrogen compounds from light petroleum oils to yield a hydrocarbon, such as aromatic hydrocarbon, with ultra-low amounts of nitrogen poisons that can otherwise deactivate acidic catalysts. The aromatic hydrocarbon thus can be used as feedstock in processes that are catalyzed by such acidic catalysts to form various petrochemical products.

BACKGROUND OF THE INVENTION

It is well known that the presence of basic nitrogen compounds in petroleum oil can deleteriously affect the performance of the subsequent catalytic processes, especially where acidic catalysts are used. For example, nitrogenous compounds present in the vacuum gas oil or residual oil can deactivate catalysts that are employed in hydrodesulfurization. A variety of chemical and physical treatments for reducing the level of nitrogen compounds in oils have been developed. Chemical methods include, for instance, (i) hydrodesulfurization/hydrodenitrogenation (HDS)/(HDN) processes and (ii) oxidation processes. HDS/HDN techniques for removing nitrogen compounds from high boiling petroleum oils are well established. Oxidation techniques, which have been developed more recently, are usually employed in combination with sulfur removal. The oxidation processes typically include an extraction or adsorption step subsequent to oxidation. Oxidation methods are described, for example, in U.S. Pat. No. 6,160,193 to Gore, U.S. Pat. No. 6,274,785 to Gore, U.S. Pat. No. 6,402,940 to Rappas, U.S. Pat. No. 6,406,616 to Rappas et al, U.S. Pat. No. 6,596,914 to Gore et al., and U.S. Patent Application Publication No. 2004/0178, 122 to Karas et al.

The most common physical techniques for removing nitrogen compounds are liquid extraction and solid adsorption which are particularly suited for treating high boiling petroleum oils. For example, U.S. Pat. No. 4,846,962 to Yao describes a method for removing basic nitrogen compounds (BNCs) from solvent extracted oils by adsorbing the BNCs to solid acidic polar adsorbents. The oils are extracted with common extraction solvents, preferably N-methyl-2-pyrrolidone (NMP). The resulting raffinate which contains the extracted oil is passed through a solid adsorption unit that contains an acidic adsorbent, such as silica-alumina, high alumina base amorphous cracking catalyst or crystalline zeolite. Depending upon the type of adsorbent and adsorption process conditions employed, the adsorbent can be regenerated by either purging with hydrogen at elevated temperatures and pressures or by washing the BNC saturated adsorbent with extractive solvent, e.g., NMP. In either case, adsorbent regeneration can be expensive.

U.S. Pat. No. 6,248,230 to Min et al. describes a solid adsorption method for removing natural polar compounds, which are predominantly basic nitrogen compounds, from hydrocarbon fractions that preferably have boiling points that range from 200 to 400° C. in advance of catalytic hydroprocessing. The process is said to significantly improve hydrotreater performance so as to produce cleaner diesel fuels with lower sulfur content. The preferred adsorbent is silica gel which is regenerated with a polar solvent, such as methanol. Similarly, U.S. Pat. No. 5,730,860 to Irvine discloses a method for treating naphtha with high concentrations of polar compounds (including nitrogen compounds) in a counter-current fluidizing adsorption process. The adsorbent is regenerated by contact with a reactivating medium such as hydrogen gas at elevated temperatures.

While adsorption can be very selective in removing nitrogen compounds from hydrocarbons, this method is not commercially feasible for a number of reasons. To begin with, implementing the technique requires a significant initial capital investment followed by substantial operating costs. The high costs are attributable, in part, to the fact that adsorption is normally a batch operation, with respect to the adsorbents, which is divided into an alternating sequence of operation and regeneration cycles. The logistics of the regenerative procedure is itself quite complex and requires complicated plant design in order to implement different fluid patterns into and out of an adsorption column as well as to reverse the flow directions at various stages during the regeneration cycle. Another reason against using adsorption is that absorbents have limited and inconsistent adsorbent capacities and lives. Using absorbents with predictable adsorbent lives is critical to the commercial success of any adsorption process. Often adsorbent life must be determined empirically for a particular application and the experiments entailed may be extensive.

The adsorption process may be suitable for removing nitrogen compounds where the nitrogen content in the hydrocarbon feed stream is extremely low, that is, in the low parts per million (ppm) or parts per billion (ppb) levels. At these minute concentrations, the process of removing nitrogen may require only infrequent adsorbent replacement and no adsorbent regeneration is needed. Since no adsorbent regeneration is required, adsorption can be advantageously based on a neutralization reaction between acid and base. Nitrogen adsorption is manifested in the form of a strong non-reversible adsorption of basic nitrogen compounds onto adsorbents with acidic sites.

With respect to prior art extraction techniques, U.S. Pat. No. 4,113,607 to Miller describes a process for upgrading hydrogenated distillate oil by extracting nitrogen compounds from the oil by liquid-liquid extraction using a solution of ferric chloride in furfural. The raffinate (oil) phase is said to be especially suitable for use as feedstock for catalytic cracking or hydroprocessing that employs an acidic catalyst. U.S. Pat. No. 4,960,507 to Evans et al. discloses a two-step extraction process for removing basic heterocyclic nitrogen from petroleum oils whereby an aqueous acidic solvent is used in a first extraction step to remove the bulk of the nitrogen compounds from the oil and an immiscible hydrocarbon solvent is used in a second extraction step to further lower the nitrogen content in the oil. Aqueous acidic solvents include carboxylic acids and halogen-substituted carboxylic acids while immiscible hydrocarbon solvents include $C_3$ to $C_{12}$ paraffins, $C_3$ to $C_{12}$ olefins and $C_3$ to $C_{12}$ ethers. U.S. Pat. No. 4,960,508 to Evans discloses a similar two-step extraction process for removing basic heterocyclic nitrogen from petroleum oils whereby an aqueous concentrated acidic solvent is used in a first extraction step to remove the bulk of nitrogen compounds from the oil and an aqueous diluted acidic solvent is used in a second extraction step to further lower the nitrogen content. The concentrated acidic solvent comprises an aqueous solution containing 85 to 95 wt % of carboxylic acids, halogen-substituted carboxylic acids and mixtures thereof while the diluted acidic solvent has the same acid mixtures as the concentrated form but at lower concentrations of about 25 to 75 wt %.

U.S. Pat. No. 4,426,280 to Chen et al. describes a two-step extraction process for removing nitrogen compounds from shale oil that employs formic acid, acetic acid, and mixtures thereof as the extraction solvents. In the initial extraction, the oil is contacted with a low acid strength solvent containing 30 to 50 wt % acids in a first extraction zone and subsequently the oil is contacted with a high acid strength solvent containing 70 to 90 wt % acids in a second extraction zone. U.S. Pat. No. 4,483,763 to Kuk et al. describes an extraction method for removing nitrogen compounds from shale oil using a three-component extraction solvent comprising an organic polar solvent, an acid and water, e.g., a mixture of furfural alcohol, hydrochloric acid and water. U.S. Pat. No. 4,169,781 to Miller describes an extraction method for removing nitrogen from coal-derived coker oil where the extraction solvent consists of a solution of ferric chloride in furfural.

Light petroleum oils that are used as petrochemical feedstocks in many catalytic processes may contain only very low levels of sulfur and nitrogen. Recent advances in catalyst technology have lead to the developed high activity catalysts that have substantially improved the productivity and economics of many of these processes. Unfortunately, these high activity catalysts are extremely sensitive to sulfur and nitrogen poison; they are particularly sensitive to basic nitrogen compounds. For example, alkylation and isomerization reactions that have been catalyzed by strong inorganic acids, such as hydrofluoric acid, sulfuric acid, and aluminum chloride slurry are now catalyzed by solid zeolitic catalysts that have very active acidic catalytic sites that are vulnerable to poison from basic nitrogen compounds in the feedstock. An example of a commercially significant alkylation reaction is that of benzene with ethylene or propylene to produce ethylbenzene or cumene, respectively. Important isomerization reactions include, for example, the production of paraxylene from othoxylene or metaxylene and the production of cyclohexane from methyl cyclopentane. In this latter synthesis, for example, the benzene feedstock must be essentially free of nitrogen compounds, preferably less than 30-100 ppb.

There is an urgent need for a cost effective, efficient process for removing nitrogen compounds from hydrocarbon to produce products such as light petroleum oils having ultra-low nitrogen content. The products are feedstock for subsequent processes that are catalyzed by catalysts that are otherwise deactivated by nitrogen compounds and particularly by basic nitrogen compounds. It is desired that the process can be continuous and operates under mild conditions.

SUMMARY OF THE INVENTION

The present invention is directed to methods of removing substantially all nitrogen compounds from light petroleum oils, which typically comprise extracted $C_6$-$C_8$ aromatics. The product is an aromatic hydrocarbon with ultra-low amounts of nitrogen poisons that can deactivate acidic catalysts. The aromatic hydrocarbon thus can be used as feedstock in processes that are catalyzed by such acidic catalysts to form various petrochemical products.

In particular, the present invention provides a highly effective liquid-liquid extraction process to remove nitrogen compounds and especially basic nitrogen compounds from light petroleum oils with high petroleum oil recovery. Subsequently, water and residual nitrogen (if any) are removed by azeotropic distillation or adsorptive distillation. The extracted oils are suitable as the feedstocks for the subsequent catalytic processes promoted with the high performance solid catalysts, which are extremely sensitive to nitrogen poison. The inventive extraction process, which is relatively simple and inexpensive, can operate under mild conditions at or near ambient temperature and pressure and employs water as the extractive solvent with or without pH adjustment to enhance the extraction.

In one particular example, the present invention can remove nitrogen from an aromatic light petroleum oils to yield an ultra-low nitrogen containing feedstock, for down stream catalytic processes that employ high performance zeolitic catalysts. The desirable reactions are catalyzed at the strong acidic sites on these catalysts, which are very vulnerable to basic nitrogen compound poisons in the feedstock. This novel process is highly efficient in removing essentially all these nitrogen compounds from the $C_6$ to $C_8$ aromatics produced for example in a liquid-liquid extraction process or extractive distillation process, where nitrogen-containing solvents are used for the aromatics extraction.

In one embodiment, the invention is directed to a process of producing a light petroleum oil that contains ultra-low levels of nitrogen containing compounds that, wherein the process includes the steps of:

(a) providing a light petroleum oil feedstock containing nitrogen-containing compounds;

(b) contacting the light petroleum oil feedstock with an aqueous extractive solvent at extraction conditions in an extraction zone;

(c) separating the product of step (b) into (i) a raffinate product stream comprising separated light petroleum oil and (ii) an aqueous extract phase; and (d) removing water from the raffinate product stream.

In another embodiment, the invention is direction to a process of converting hydrocarbons in a reaction that is catalyzed by acidic catalysts that comprises the steps of:

(a) providing a light petroleum oil feedstock containing nitrogen-containing compounds;

(b) contacting light petroleum oil feedstock containing nitrogen-containing compounds with a polar extractive solvent;

(c) separating the light petroleum oil from the polar extractive solvent to yield light petroleum oil containing ultra-low levels of nitrogen-containing compounds;

(d) removing water from the separated light petroleum oil to yield a dehydrated light petroleum oil; and (e) contacting the dehydrating light petroleum oil at hydrocarbon converting conditions with an acidic catalyst.

DETAILED DESCRIPTION OF PREFERRED EMBODIMENTS

The present invention is directed to a process for removing nitrogen compounds from light petroleum oils to yield light petroleum aromatic products with ultra-low nitrogen levels. The process will produce light petroleum oils with a nitrogen content (also referred to as the "nitrogen compounds content") of 1 ppm or less, preferably with a nitrogen content of 100 ppb or less, and more preferably with a nitrogen content of 30 ppb or less. The nitrogen-containing light petroleum oils feedstock for the nitrogen removal process can comprise, for instance, the extracted aromatic products from the pyrolysis gasoline from a steam cracker, the extracted aromatic products from reformate from a catalytic reformer, or the extracted aromatic products from naphtha fraction from petroleum coker oil, or coal-derived coker oil.

Figure 1:
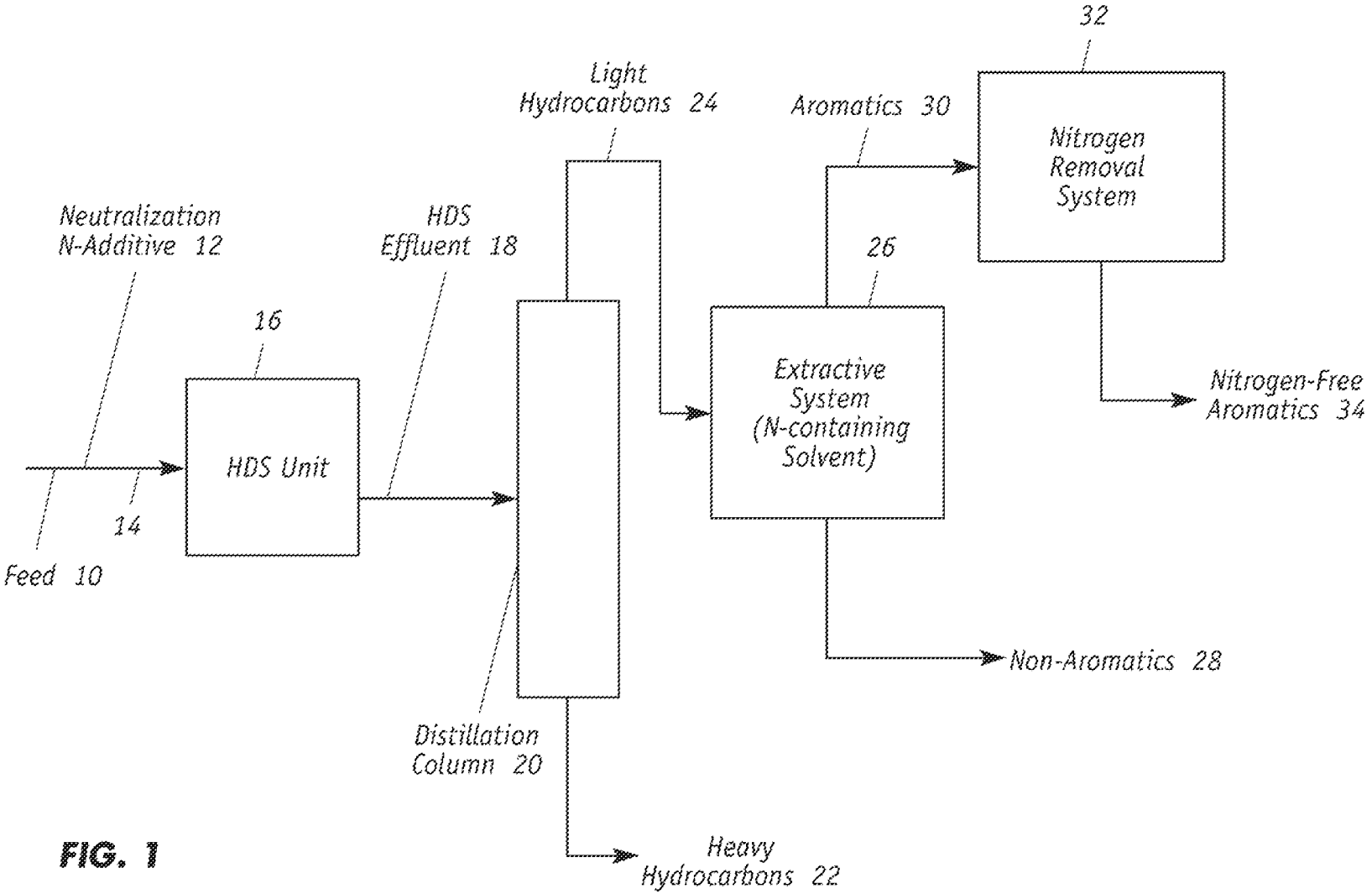
FIGS. 1 and 2 are flow diagrams illustrating two extraction processes for removing nitrogen compounds from hydrocarbons.

FIG. 1 illustrates a process for removing nitrogen compounds from a liquid hydrocarbon to yield an aromatics-containing product that is essentially free of nitrogen compounds. As shown, light petroleum feed 10 is optionally mixed with a neutralization nitrogen-containing additive 12 and the combined stream 14 is fed to a conventional hydrodesulfurization (HDS) unit 16 that primarily removes sulfur from the feed stream 14. The additive 12 comprises any suitable nitrogen compound that neutralizes the acidic ions that may be present in light petroleum feed 10. Preferably, the additive 12 comprises water soluble nitrogen compounds that have relatively low-boiling points of less than about 135° C., as further described herein. Effluent 18 from the HDS unit 16 is then charged into a distillation column 20 where a heavy hydrocarbons stream 22 comprising a $C_8$+ fraction is removed from the bottom of the column 20 and a light hydrocarbons stream 24 comprising a $C_6$-$C_8$ fraction is produced overhead. The overhead fraction stream 24 is fed to an aromatics extraction system 26 where the desired aromatics are extracted with a solvent or solvent mixture that typically contains nitrogen-containing extractive solvents such as N-formyl-morpholine (NFM) or N-methyl-2-pyrrolidone (NMP). Aromatics extraction system 26 preferably is a conventional liquid-liquid extraction column or an extractive distillation column. Non-aromatics are discharged from the extraction system 26 via stream 28. A nitrogen compounds removal system 32 is employed to remove nitrogen compounds from the purified aromatics product stream 30 to yield an essentially nitrogen-free aromatics stream 34. The invention is based in part on the development of a novel nitrogen compounds removal system that employs water as the extractive solvent, with or without pH adjustment to enhance the extraction, which is further described herein.

There are three primary sources of nitrogen contamination in the light petroleum oils feedstock and they are: (1) naturally occurring nitrogen compounds originally in the petroleum oil, (2) anti-corrosion agents, e.g., basic nitrogen compounds, that are added to the feedstock before it is introduced into the HDS unit 16, and (3) the nitrogen-containing extractive solvents (in extraction system 26) that are used in removing the aromatics. The naturally occurring nitrogen compounds can be readily removed by HDS, so they are unlikely to be present in the purified aromatics product stream 30.

The anti-corrosion agents are normally added to neutralize the acidic ions, such as $SO_3^-$, $SO_4^-$, and CN*, that are generated in the up-stream process. If the anti-corrosion agent is used, any excess amounts of the additive are most likely cracked or reacted in the HDS unit 16 to form lighter nitrogen compounds with boiling points that are below that of xylenes which are in the range of 135-140° C. Nevertheless, the HDS effluent 18 will most likely contain some nitrogen up to at level of about 0.3 ppm depending on the amount and type of additives that are employed. Typically, pyrolysis gasoline and the coker naphtha are treated in a HDS unit 16 and the effluent from the HDS unit is fed to a distillation column to cut out the heavies having boiling higher than xylenes. The fraction containing benzene, toluene, xylenes, $C_8$– non-aromatics, and some trace amounts of nitrogen compounds that are derived from the anti-corrosion additive, is then sent to the aromatics extraction system 26 to produce the purified aromatics product stream 30 which can be catalytically processed into other petrochemicals.

With respect to the aromatics extraction system 26, when liquid-liquid extraction is employed, the preferred solvents are sulfolane/water, tetraethylene glycol (TEG)/water, N-formyl-morpholine (NFM)/water, N-methyl-2-pyrrolidone (NMP)/water, and mixtures thereof. When extractive distillation is employed, the preferred solvents are NFM/water and NMP/water. In an ideal LLE or ED process, the boiling point of extractive solvent should be substantially higher than that of the hydrocarbon feed, so that the solvent will not contaminate the raffinate and the extract products. The boiling points of NFM (243° C.) and NMP (208° C.) are not high enough so that the aromatic products from the extraction process will have noticeable amounts of nitrogen compounds. As a comparison, the benzene produced from the Krupp-Uhde extractive distillation process using NFM as the extractive solvent contains typically 2-3 ppm (2,000-3,000 ppb) nitrogen, which is substantially higher than the 30-100 ppb level, which is desired for the inventive nitrogen removal process.

As is apparent, the nitrogen-containing extractive solvents and, to a lesser extent, the anti-corrosion agents are the main sources of nitrogen compounds in the purified aromatics product stream 30. It is expected that the typical level of nitrogen compounds in the purified aromatics product stream 30 is about 2 to 3 ppm. An aspect of the present invention is to substantially remove the nitrogen compounds from the purified aromatics product stream 30 to produce aromatic hydrocarbons with ultra-low nitrogen contaminant levels.

The invention is based in part on the observation that essentially all nitrogen compounds having boiling points in the boiling range of $C_6$ to $C_8$ hydrocarbons are water-soluble. Indeed, all nitrogen compounds in the boiling range of approximately $C_6$ to $C_8$ aromatics that are listed found in the Merck Index (I edition (1989)), are water-soluble. The boiling points and water solubilities (as measured at room temperature) of 11 of these nitrogen-containing compounds are set forth in the following table.

| Compound | Boiling Point (° C.) | Water-Soluble |
|---|---|---|
| diethylamine | 56 | yes |
| N-butylamine | 78 | yes |
| diisopropylamine | 84 | yes |
| pyrrolidine | 89 | yes |
| triethylamine | 89-90 | slightly soluble |
| 3-pyrroline | 90-91 | yes |
| N-amylamine | 104 | yes |
| N-dipropylamine | 110 | yes |
| spermidine | 128-130 | yes |
| methylhexaneamine | 130-135 | yes |
| cyclohexylamine | 134.5 | yes |

It is expected that the performance of the present nitrogen removal process can be improved by using additives with boiling points of about 135° C. or less. For example, high-boiling neutralization nitrogen additives, that are used in the prior art, such as the anti-corrosion additives that are added to the HDS unit, can be replaced with appropriate low-boiling, water-soluble nitrogen additives. With the exception of triethylamine, which is only slightly water soluble, any of the other above listed additives, or combinations thereof, can be used.

Figure 3:
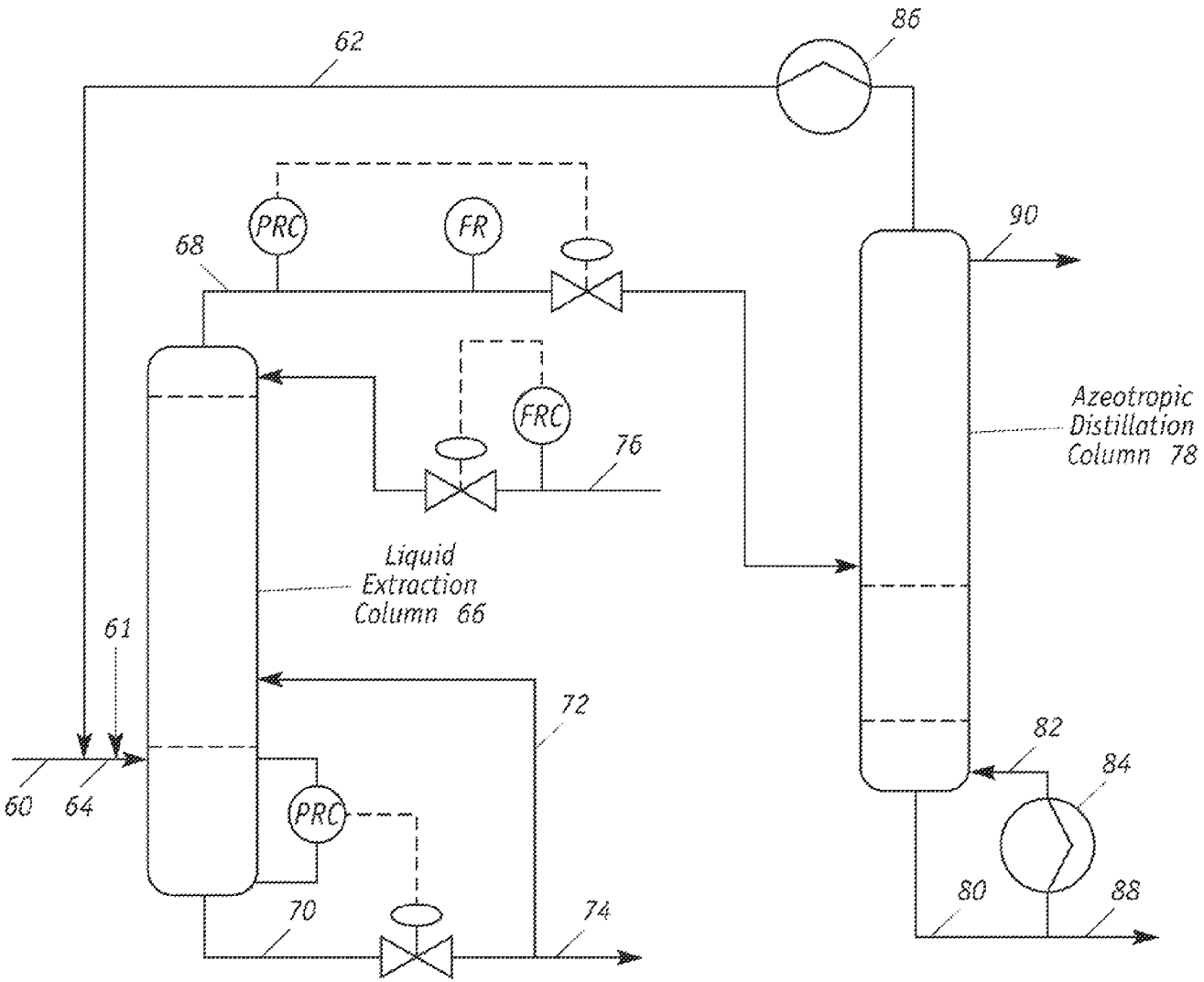
FIGS. 3, 4, and 5 illustrate different embodiments of nitrogen compound removal systems.
Figure 4:
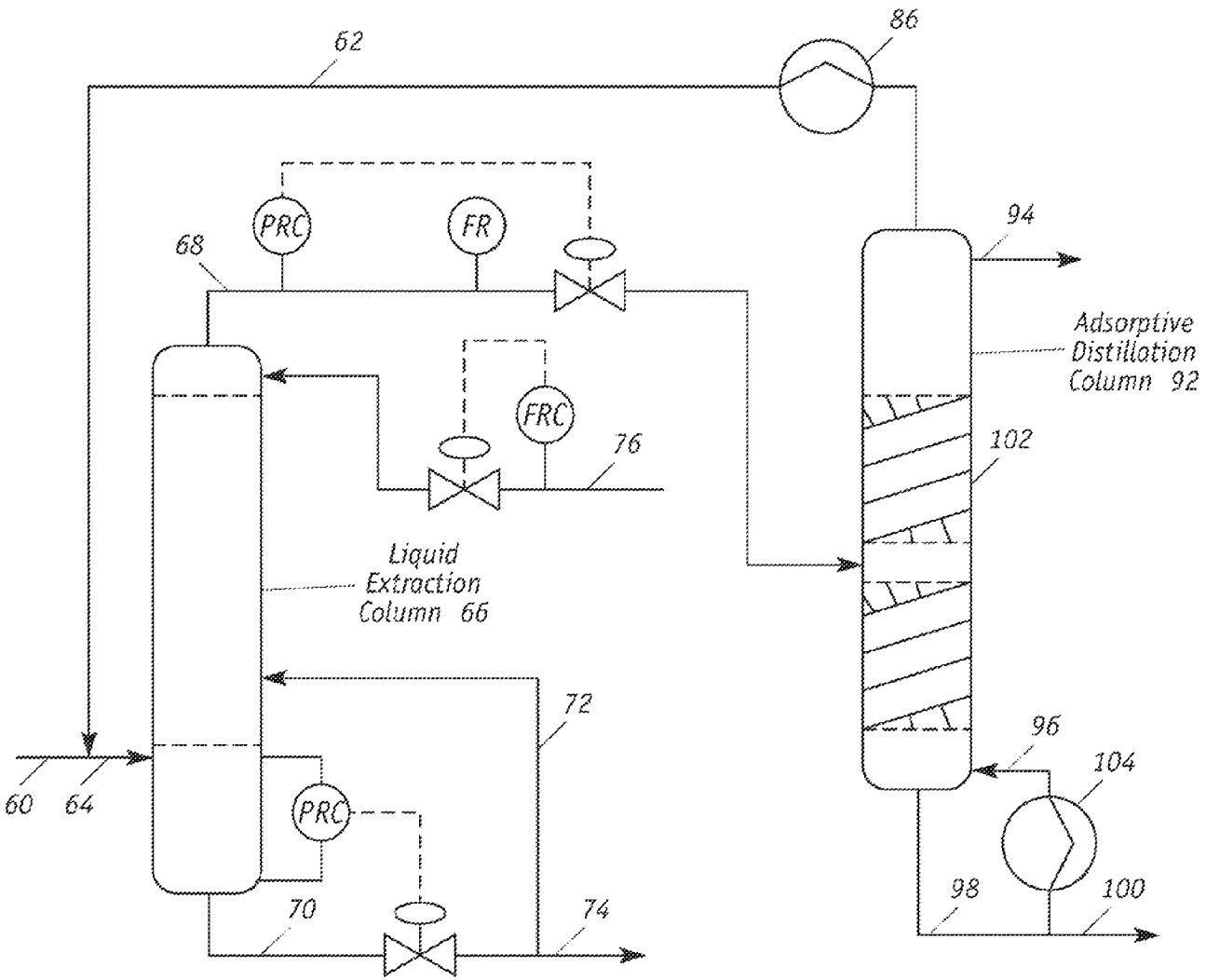
Figure 5:
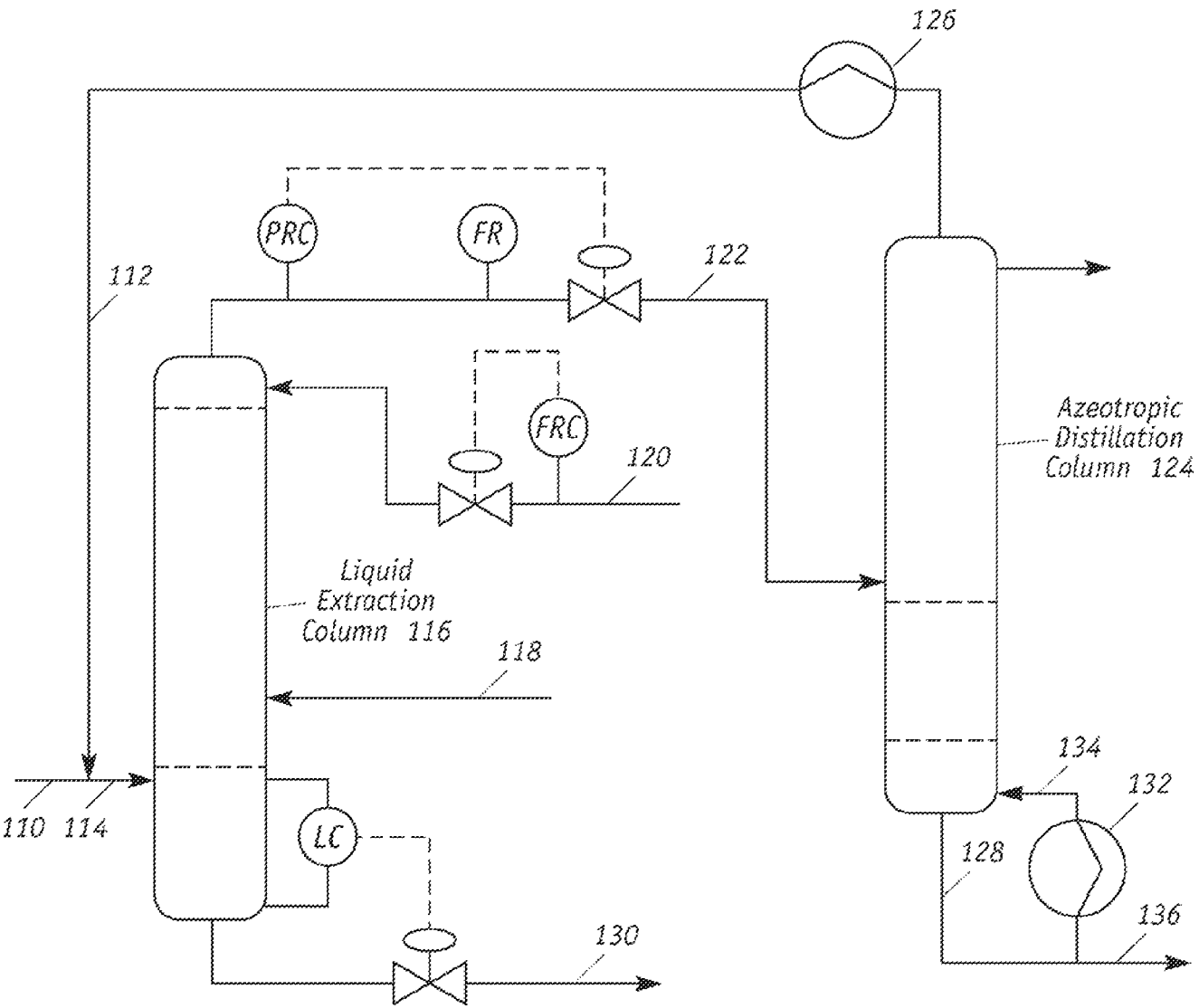

As further described in FIGS. 3-5, a preferred nitrogen removal system 32 (of FIG. 1) has (i) a liquid-liquid extraction (LLE) unit and (ii) an azeotropic distillation column or adsorptive distillation column. The LLE removes the majority of the nitrogen compounds and yields an aromatic product while the azeotropic distillation column or adsorptive distillation column removes water and minor residual traces of the nitrogen (if any) from the aromatic products. The LLE unit uses a non-toxic, non-corrosive, and low cost polar extractive solvent. A particularly preferred solvent is water, with or without the pH adjustment to enhance the extraction. The LLE unit preferably comprises a continuous multi-stage contacting device that is designed for counter-current extraction. Suitable designs for nitrogen extraction include, for example, (i) columns that are equipped with trays, packing, or rotating discs, (ii) pulse columns, (iii) multi-stage mixers/settlers, and (iv) rotating type contactors.

It has been further discovered that the low-boiling (<135° C.) nitrogen compounds in the light petroleum oils are generally all soluble in water. Any nitrogen compounds in the feedstock to the aromatic extraction unit 26 of the process illustrated in FIG. 1 is water-soluble since the feedstock contains only $C_6$ to $C_8$ hydrocarbons, which have boiling points below 140° C. The nitrogen-containing solvents used in the aromatic extraction unit 26, although having much higher boiling points than that of the hydrocarbon feedstock, are readily soluble in water.

Figure 2:
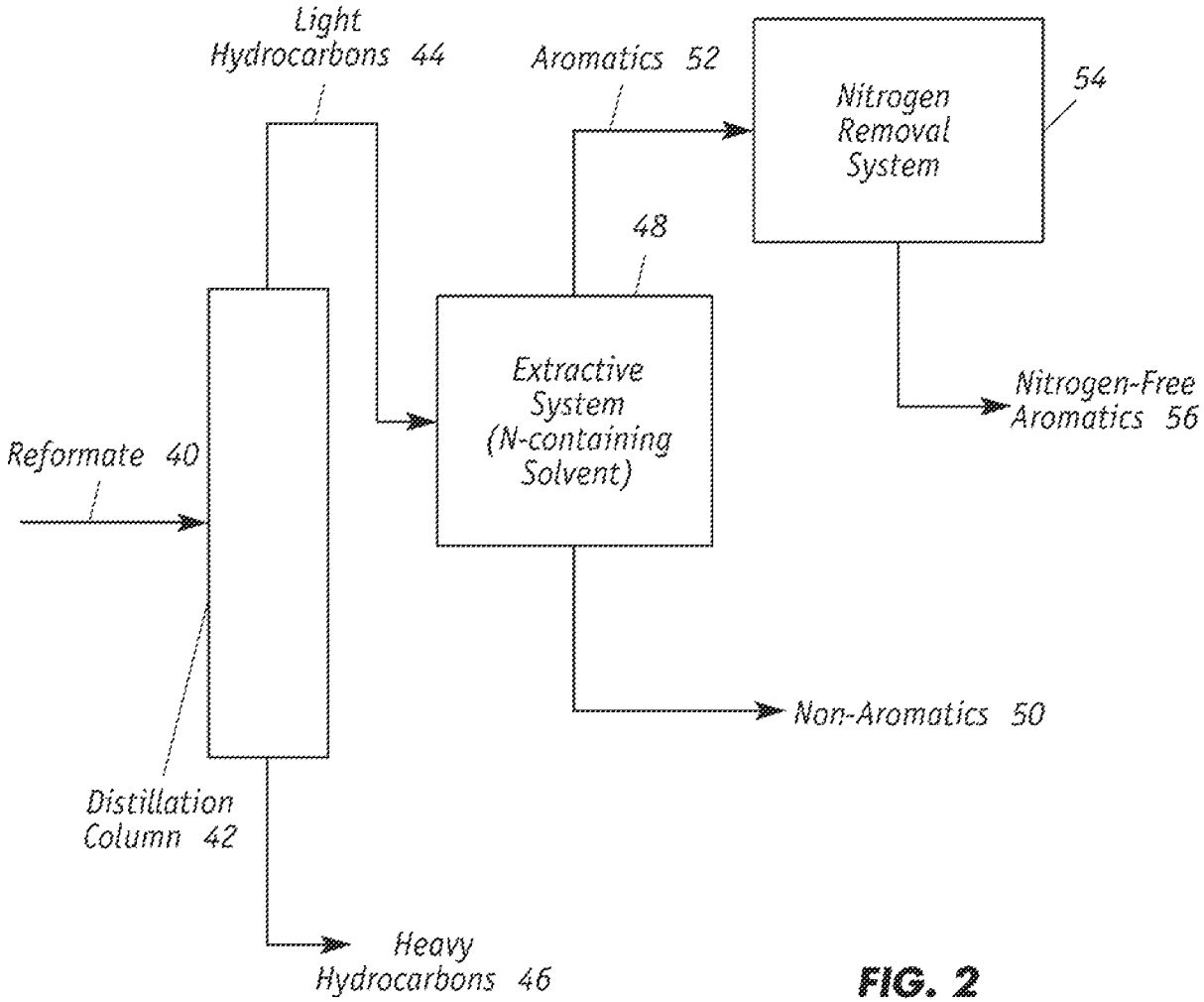

FIG. 2 illustrates another process for removing nitrogen compounds from a liquid hydrocarbon to yield an aromatics-containing product that is essentially free of nitrogen compounds. As shown, reformate 40 which is produced in a catalytic reformer is fed to a distillation column 42 where a heavy hydrocarbons stream 46 containing a $C_8$+ fraction is removed from the bottom of column 42 and a light hydrocarbons stream 44 containing a $C_6$-$C_8$ fraction is recovered from the overhead. Overhead stream 44 is then introduced into an aromatics extraction system 48, such as an LLE or ED system, where the desired aromatics are extracted with a solvent or solvent mixture that typically contains nitrogen compounds. Non-aromatics are discharged from the extraction system 48 via stream 50. A nitrogen removal system 54 is employed to remove nitrogen compounds from the purified aromatics product stream 52 to yield an essentially nitrogen-free aromatics stream 56. A preferred nitrogen removal system 54 includes an LLE and an azeotropic distillation column or adsorptive distillation column as depicted in FIGS. 3-5.

FIG. 3 illustrates a nitrogen removal process that includes liquid-liquid extraction and azeotropic distillation. For this continuous process, purified aromatics 60, typically containing ppm levels of nitrogen compounds, are preferably mixed with overhead condensate 62, which is further described herein, and fed via line 64 into the lower portion a liquid extraction column (LEC) 66 which is preferably a continuous counter-current contacting column. De-ionized extractive water is introduced through line 76 into the top of the LEC 66. The flow rate of water that is introduced into the column 66 through a control valve is monitored and adjusted by a flow rate controller (FRC) in order to control the water-to-aromatic feed (W/F) weight ratio. The W/F weight ratio is typically in the range of from 0.01 to 100, preferably from about 0.05 to 50, and more preferably from about 0.1 to 10. The higher the W/F weight ratio used, the greater the amount of nitrogen compounds removed. In this embodiment, the solvent for the LEC 66 can consist essentially of water.

The extraction process can be operated under mild conditions at a temperature of from 0 to 1.00° C. and preferably from about 40 to 60° C. and at a pressure of from 0 to 100 psig and preferably from about 0 to 20 psig. Since the solubility of aromatics in water is not insignificant and the solubility increases with temperature, nitrogen extraction should be carried out at temperatures of 60° C. or less. As an example, the solubility of benzene in water at ambient temperature (23° C.) and 45° C. is 0.188 and 0.235 wt %, respectively. Although the interface between the aromatic phase and water phase can be designed to be located at any vertical position along the extraction column 66, a preferred operating mode establishes the interface toward the bottom of the column 66. A preferred method of contacting the aromatic phase and the water phase within column 66 is to deliver the water as a continuous phase and the aromatics as a non-continuous or discrete phase, e.g., small droplets, or vice-versa, where the aromatics form a continuous phase and the water forms a non-continuous phase.

The water extract 70 from the column 66 contains some aromatics and extracted nitrogen compounds which are typically present in the low ppm concentration levels. The water extract 70 is withdrawn from the bottom of the extractor column 66 where the level of water within the column 66 is maintained by a level controller (LC). A portion of the water extract 70 is optionally recycled back to a lower portion of column 66 through line 72 and the remaining portion 74 of the water extract is disposed as waste water. The raffinate stream 68 exits from the top of the column 66 that is equipped with a pressure relief controller (PRC) and flow rate (FR) monitor that keep the column 66 full of liquid. The raffinate stream 68 is essentially free of nitrogen compounds, that is, the amount of nitrogen compounds present is in the ppb level or less. The raffinate stream 68 is then fed into the middle portion of an azeotropic distillation column (AZC) 78 where water is separated from the aromatics. The water is predominantly in the form of dissolved water and trapped free water.

To significantly improve the performance of column 66 with respect to nitrogen removal, a trace amount of acid is optionally continuously added to stream 60 via line 61 to at least partially neutralize the basic nitrogen compounds, to form weak salts, in the aromatic feedstock before the feedstock enters the water extraction in column 66. An in-line static mixer can be used to mix the acid with the aromatic feedstock. Suitable acids include, but not limited to, any water-soluble organic acids, such as formic acid, acetic acid, propionic acid, butyric acid, valeric acid and the mixtures thereof, and any water-soluble inorganic acids, such as sulfuric acid, hydrochloric acid, hydrofluoric acid, boric acid, nitric acid, phosphoric acid and the mixtures thereof. The amount of acid addition is 1 to 100 times, and preferably 1 to 5 times, of the nitrogen content in feedstock 60.

In the AZC 78, water and benzene form a minimum-boiling azeotrope that has a boiling range of 69-70° C. and rises to the top the column 78 as vapor. The small amount of water present in the benzene within the column 78 is less than 600 ppm. The overhead vapor is condensed by cooler 86 and the condensate 62 is recycled back and mixed with the purified aromatics 60. Given that $C_7$+ aromatics have higher nitrogen compound tolerance than do benzene, dried $C_7$+ aromatic products are withdrawn via line 80 from the bottom of the AZC 78. A portion of the dried $C_7$+ aromatic products is heated by a reboiler 84 and recycled back through line 82 to bottom of the AZC 78 to provide the requisite heat for distillation. Dried benzene, which has ultra-low nitrogen content, is withdrawn from a side-cut near the top of the AZC 78 via line 90. If benzene is the only compound in the aromatic feedstock 60, the dried and nitrogen-free benzene product is withdrawn from the bottom of AZC 78 through line 88.

FIG. 4 illustrates a nitrogen removal process that includes liquid-liquid extraction (LLE) and adsorptive distillation. The process configuration and operation conditions are essentially the same as those illustrated in FIG. 3 in that they have the same LLE operation for extracting the nitrogen compounds from the purified aromatics except that instead of using azeotropic distillation to dry and to remove residual nitrogen compounds, if any, an adsorptive distillation column (ADC) 92 is used. Specifically as shown in FIG. 4, purified aromatics 60 is preferably mixed with overhead condensate 62, which is further described herein, and fed via line 64 into the lower portion a liquid extraction column (LEC) 66. Fresh extractive water is introduced through line 76 into the top of the LEC 66.

The water extract 70 from the column 66 is withdrawn from the bottom of the extractor column 66. A portion of the water extract 70 is recycled back to a lower portion of column 66 through line 72 and the remaining portion 74 of the water extract is disposed as waste water. The raffinate stream 68 that exits from the top of the column 66, which has with no more than a trace of nitrogen, is fed into the middle portion of the ADC 92 where water and trace nitrogen compounds, if any, are separated from the aromatics. Beds of adsorbent 102 are packed within the middle portion of the ADC 92 which is equipped with trays or packing. In the case where the column equipped is with trays, the adsorbent is packed in the downcorner of the trays through which the liquid phase flows. Preferred adsorbents are solids that have strong acidic sites that attract, adsorb and neutralize basic nitrogen compounds. Suitable solid adsorbents include, for example, ion-exchange resins, such as AMBERLYST 15, zeolites, and mixtures thereof. During distillation, the column temperature is too high for the adsorption of water and benzene; rather an azeotrope is formed that exits the column 92 as vapor which is subsequently condensed by cooler 86. The dried $C_7$+ aromatics with ultra-low nitrogen content are withdrawn from the bottom of the ADC 92 via line 98. A portion of the dried aromatic products is heated by a reboiler 104 and recycled back through line 96 to bottom of the ADC 92 to provide the requisite heat for distillation. Dried benzene which has ultra-low nitrogen content is withdrawn from side-cut from the column 92 through line 94. If benzene is the only compound in the aromatic feedstock 60, the dried and nitrogen-free benzene product is withdrawn from the bottom of ADC 92 through line 100. After water extraction, the nitrogen compound concentration in the aromatics is so low that it is expected that the adsorbent in the column 92 will last a long time before it has to be replaced or regenerated.

Instead of using azeotropic or adsorptive distillation, the aromatics can be dried by adsorption with clays or other adsorbents or the aromatics can be dried with salts. Adsorption with clays has been used in the petroleum and petrochemical industries to remove water and unsaturated hydrocarbons, such as olefins and dienes, from aromatics. However, such an adsorption process is normally a batch operation with respect to the adsorbents, and is divided into a sequence of alternating operation and regeneration cycles and therefore is less preferred. In addition, the logistics of the regeneration procedure to replenish the adsorbents is quite complicated.

FIG. 5 illustrates a nitrogen removal process that also includes liquid-liquid extraction and azeotropic distillation. In addition, the process illustrates another important aspect of this invention: which is that the performance of the LLE step can be significantly improved by lowering the pH of the water solvent to less than 7 by adding trace quantity of acids. Preferably, the pH is lowered to 5.0 or less and more preferably 4.0 or less but the degree of acidity depends on the level of basic nitrogen compounds entering the LLE process. Typically, the lower the pH of the water used, the greater the amount of nitrogen compounds that is removed. Suitable acids for pH adjustment include, but not limited to, any water-soluble organic acids, such as formic acid, acetic acid, propionic acid, butyric acid, valeric acid and the mixtures thereof, and any water-soluble inorganic acids, such as sulfuric acid, hydrochloric acid, hydrofluoric acid, boric acid, nitric acid, phosphoric acid and the mixtures thereof. The preferred acids are acetic acid and formic acid, with acetic acid being particularly preferred. The acids will neutralize the basic nitrogen compounds to produce weak salts in the process that are readily dissolved in water and therefore the basic nitrogen compounds can be more easily removed along with the water. By using acidified water, the amount of water needed in the LLE extraction process will be significantly reduced as well. The subsequent azeotropic distillation column then serves primarily to dehydrate the aromatic product; water removal by itself requires fewer separation stages.

Referring to FIG. 5, purified aromatics 110, containing ppm levels of nitrogen compounds, is preferably mixed with overhead condensate 112, which is further described herein, and fed via line 114 into the lower portion a liquid extraction column (LEC) 116 which preferably operates in a continuous counter-current fashion. In this embodiment, the extractive solvent which preferably consists essentially of water is split into two portions: (i) a first portion of de-ionized extractive water that is introduced through line 120 near the top of the LEC 116 and (ii) a second portion of acidified de-ionized water that is fed through line 118. The fresh de-ionized water is introduced through line 120 into the column LEC 116, while the acidified de-ionized water is introduced to column LEC 116 separately through line 118. The de-ionized water from the top of the column helps prevent acid contamination. The W/F weight ratio, which is based on total amount of water that is introduced through lines 118 and 120, is typically in the range of from 0.01 to 100, preferably from about 0.05 to 50, and more preferably from about 0.1 to 10. The extraction process is preferably operated under mild conditions at a temperature of from 0 to 100° C. and preferably from about 40 to 60° C. and at a pressure of from 0 to 100 psig and preferably from about 0 to 20 psig.

The water extract 130 from the column 116 contains small amounts of aromatics and extracted nitrogen compounds which are typically present in the low ppm concentration levels. The water extract 130 is withdrawn from the bottom of the extractor column 116 where the level of water in the column 116 is maintained by a level controller (LC). The water is not recycled back into the column 116. The raffinate stream 122, which contains aromatics and only trace amounts of nitrogen compounds, exits from the top of the column 116 that is equipped with a pressure relief controller (PRC) and flow rate (FR) monitor that keep the column 116 full of liquid. The raffinate stream 122 is then fed into the middle portion of an azeotropic distillation column (AZC) 124 where water along with trace nitrogen compounds, if any, are separated from the aromatics. The water is predominantly in the form of dissolved water and trapped free water. In the AZC 124, water and benzene form a minimum-boiling azeotrope which rises to the top the column 124 as vapor. The overhead vapor is condensed by cooler 126 and the liquid 112 is recycled back and mixed with the purified aromatics 110. Dehydrated (dried) aromatic products, having ultra-low levels of nitrogen, are withdrawn via line 128 from the bottom of AZC 124. A portion of the dried aromatic products is heated by a reboiler 132 and recycled back through line 134 to bottom of the AZC 124. The primary function of the AZC 124 is to dry the aromatics and this procedure requires fewer separation stages relative to the AZC 78 that is employed in the process depicted in FIG. 3.

The aromatic light petroleum products with ultra-low nitrogen contents produced with the inventive process is particularly suited as feedstock for subsequent catalytic processes that are promoted by high performance solid catalysts that are sensitive to nitrogen poisoning. These conventional catalytic processes include, for example, benzene alkylation with ethylene or propylene to produce ethylbenzene or cumene, respectively, mixed xylenes isomerization to produce paraxylene, methyl cyclopentane isomerization to produce cyclohexane.

EXAMPLE

The following examples are presented to further illustrate different aspects and embodiments of the invention and are not to be considered as limiting the scope of the invention.

Example 1

In this example, an aromatic hydrocarbon composition that is representative of the HDS effluent 18 that would be fed into the distillation column 20 of FIG. 1 was prepared. The composition includes a small amount of high molecular weight nitrogen compounds of the kind used as the neutralization additives that are added to the feedstock 10 before being that is charged into the HDS unit 16. The composition which consisted of almost 98 wt % aromatics included the following components as set forth in Table 1.

TABLE 1

| Component | weight % |
|---|---|
| $C_6$ paraffins | 0.67 |
| $C_7$ paraffins | 0.14 |
| cyclopentane | 0.49 |
| cyclohexane | 0.64 |
| benzene | 83.96 |
| toluene | 13.93 |
| nitrogen compounds | (0.3 ppm) |

Approximately 100 grams of this composition were contacted with 100 grams of deionized water in a separatory funnel at ambient temperature. The funnel was shaken vigorously to allow the immiscible components to be well mixed; once the shaking stopped, the aromatics and water separated from each other instantaneously so as to establish an aromatic phase and an aqueous phase. Trace nitrogen analysis showed that the nitrogen content in the aromatic phase remained unchanged at 0.3 ppm which demonstrated that the nitrogen compounds, which have very high boiling points of at least about 200 to 300° C. are essentially insoluble in water.

Example 2

Using the same extraction procedure described in Example 1, a benzene composition containing about 97.5 wt % benzene, 2.5 wt % of $C_6$ to $C_7$ non-aromatics, and trace amounts (2.9 ppm) of nitrogen compounds was extracted three times with fresh de-ionized water. The water-to-benzene composition weight ratio for each extraction was 1:1. The hydrocarbon (benzene) phase was analyzed for trace nitrogen after each extraction stage and the results are given in Table 2.

TABLE 2

| Extraction Stage | Nitrogen in Benzene Phase (ppm) | Nitrogen Removal (%) |
|---|---|---|
| 0 | 2.9 | 0.0 |
| 1 | 0.363 | 87.5 |
| 2 | 0.088 | 97.0 |
| 3 | 0.078 | 97.3 |

As is apparent, the nitrogen content in the benzene phase was reduced from 2.9 ppm to 0.078 ppm (or 78 ppb) which is a 97.3% reduction. This demonstrates that water is an excellent extractive solvent to remove nitrogen compounds from benzene.

Example 3

The nitrogen extraction procedure of Example 2 was repeated but with less water, i.e., at lower water-to-benzene composition ratios of 0.5 and 0.1. The hydrocarbon (benzene) phase was analyzed for nitrogen after each extraction stage and the results are given in Table 3.

TABLE 3

| Extraction Stage | Nitrogen in Benzene Phase (ppm) | Nitrogen Removal (%) |
|---|---|---|
| Experiment 1 Water-To-Benzene Weight Ratio: 0.5 | | |
| 0 | 2.9 | 0.0 |
| 1 | 0.432 | 85.1 |
| 2 | 0.183 | 93.7 |
| Experiment 2 Water-To-Benzene Weight Ratio: 0.1 | | |
| 0 | 2.9 | 0.0 |
| 1 | 1.34 | 53.8 |
| 2 | 0.577 | 80.1 |
| 3 | 0.375 | 87.1 |
| 4 | 0.289 | 90.0 |
| 5 | 0.231 | 92.0 |

This experiment demonstrated that more nitrogen compounds are extracted from the benzene phase when more extractive solvent, i.e., water, is used at any particular stage. Moreover, for each water-to-benzene weight ratio, successive extraction will further reduce the amount of nitrogen in the benzene phase.

Example 4

The benzene composition used in Examples 2 and 3 was analyzed with a gas chromatography-mass spectrometer to identify the molecular structures of the trace nitrogen compounds that were present. It was found that the nitrogen-containing compound in the benzene composition was substantially morpholine which is a decomposition fragment from the NFM solvent used in the aromatics extractive system, e.g., system 26 of FIG. 1. Since morpholine is water soluble, this experiment confirms that the liquid extraction column LEC 66 as illustrated in FIG. 3 can be employed to extract the morpholine from the purified aromatics feed stream 60. The residual morpholine in the aqueous raffinate stream 68, if any, can be removed from the bottom of the azeotropic distillation column 78, since the boiling point of morpholine (128.3° C.) is much higher than that of the benzene and morpholine does not form an azeotrope with water or benzene.

Example 5

This example demonstrates that acidified water is more effective than pure water in extracting nitrogen from aromatics. Using the same extraction procedure described in Example 1, benzene compositions containing 2.9 ppm nitrogen were extracted with de-ionized water and acidified de-ionized water by multi-stage extraction at room temperature. The water-to-benzene weight ratio was 0.2 in each instance. The acidified water was prepared by adding acetic acid to de-ionized water to lower the pH from 7.0 to 5.11. The benzene composition phase after each extraction was analyzed for trace nitrogen content and comparative extraction results are given in Table 4.

TABLE 4

| | Nitrogen in Benzene Phase (ppm) | |
|---|---|---|
| Extraction Stage | Acidified Water | Non-acidified Water |
| 0 | 2.9 | 2.9 |
| 1 | 0.694 | 0.841 |
| 2 | 0.253 | 0.330 |
| 3 | 0.123 | 0.236 |
| 4 | 0.105 | 0.210 |
| 5 | 0.095 | 0.170 |
| 4 more extractions with non-acidified water | 0.086 | — |

As is apparent, acidified water is more effective in extracting nitrogen compounds from benzene than the non-acidified water. With acidified water, the nitrogen content in benzene was lowered to 95 ppb in a 5-stage extraction process where the water-to-benzene weight ratio was only 0.2. Under the same condition, the non-acidified water was only able to lower the nitrogen content to 170 ppb.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

The invention claimed is:

1. A process of converting hydrocarbons in a reaction that is catalyzed by acidic catalysts that comprises the steps of:

(a) providing a light petroleum oil feedstock containing up to 2 ppm nitrogen-containing compounds;

(b) contacting light petroleum oil feedstock containing nitrogen-containing compounds with a polar extractive solvent;

(c) separating the light petroleum oil from the polar extractive solvent to yield light petroleum oil containing ultra-low levels of nitrogen-containing compounds;

(d) removing water from the separated light petroleum oil to yield a dehydrated light petroleum oil that has a nitrogen content of 100 ppb or less; and (e) contacting the dehydrating light petroleum oil at hydrocarbon converting conditions with an acidic catalyst.

2. The process of claim 1 wherein the polar extractive solvent comprises water.

3. The process of claim 2 wherein the water has a pH of less than 7.

4. The process of claim 3 wherein acids are added to the light petroleum oil feedstock before, during, or both before and during step (b) to at least partially neutralize some nitrogen-containing compounds in the light petroleum oil feedstock.

5. The process of claim 4 wherein the acids comprise acetic acid, formic acid, or both.

6. The process of claim 4 wherein the acids comprise acetic acid.

7. The process of claim 1 wherein the dehydrated light petroleum oil contains 30 ppb or less of nitrogen-containing compounds.

8. The process of claim 1 wherein the acidic catalyst is selected from the group comprises zeolites and other solid catalysts that are sensitive to basic nitrogen poison.

9. The process of claim 1 wherein the light petroleum oil feedstock is an extracted aromatic product from the pyrolysis gasoline, reformate, naphtha or coal-derived coker oil.

10. The process of claim 9 wherein the light petroleum oil feedstock is produced by liquid-liquid extraction or extractive distillation using a nitrogen-containing extractive solvent.

11. The process of claim 10 wherein the extractive solvent is selected from the group consisting of N-formyl-morpholine (NFM), N-methyl-2-pyrrolidone (NMP), and mixtures thereof.

12. The process of claim 10 wherein the light petroleum oil feedstock contains light nitrogen-containing compounds generated from neutralization nitrogen-containing additive that is a corrosion inhibitor which neutralizes acidic ions present in the stream producing the light petroleum feedstock.

13. The process of claim 10 wherein the light petroleum oil feedstock contains the light nitrogen-containing compounds that are generated from the NFM, NMP, or mixtures thereof.

14. The process of claim 10 wherein the light nitrogen-containing compounds have boiling point no more than about 135° C. after distillation to remove the heavier portion of a neutralization nitrogen-containing additive that is insoluble in water.

15. The process of claim 10 wherein the neutralization nitrogen-containing additive is water-soluble and has a boiling point of about 135° C. or less.

16. The process of claim 14 wherein the additive is selected from the group consisting of diethylamine, n-butylamine, diisopropylamine, pyrrolidine, 3-pyrroline, n-amylamine, n-dipropylamine, spermidine, methylhexaneamine, cyclohexylamine, and mixtures thereof.

17. The process of claim 1 wherein the light petroleum oil feedstock comprises extracted aromatics that have boiling points of less than about 140° C. and wherein essentially all of the nitrogen-containing compounds in the petroleum oil feedstock that have boiling points in this boiling range are soluble in water.

18. The process of claim 1 wherein step (d) comprises removing water from the separated light petroleum oil by azeotropic distillation.

19. The process of claim 1 wherein step (d) comprises removing water from the separated light petroleum oil by adsorption with clays or inorganic salts.

20. The process of claim 1 wherein step (d) comprises removing water from the separated light petroleum oil by adsorptive distillation.

* * * * *